US011478399B2

(12) United States Patent
de Alva

(10) Patent No.: US 11,478,399 B2
(45) **Date of Patent: *Oct. 25, 2022**

(54) SEXUAL AID SYSTEM

(71) Applicant: John de Alva, Chula Vista, CA (US)

(72) Inventor: John de Alva, Chula Vista, CA (US)

( * ) Notice: Subject to any disclaimer, the term of this patent is extended or adjusted under 35 U.S.C. 154(b) by 155 days.

This patent is subject to a terminal disclaimer.

(21) Appl. No.: 13/764,678

(22) Filed: Feb. 11, 2013

(65) Prior Publication Data

US 2014/0228628 A1 Aug. 14, 2014

(51) Int. Cl.
*A61H 19/00* (2006.01)
*A61H 23/02* (2006.01)

(52) U.S. Cl.
CPC ..... *A61H 19/44* (2013.01); *A61H 19/34* (2013.01); *A61H 19/50* (2013.01); *A61H 23/02* (2013.01); *A61H 2201/165* (2013.01); *A61H 2201/1685* (2013.01)

(58) Field of Classification Search
CPC ..... A61H 19/34; A61H 19/40; A61H 19/44; A61H 19/50
USPC ..... 600/38–41; 128/897–898
See application file for complete search history.

(56) References Cited

U.S. PATENT DOCUMENTS 8,371,999 B2 * 2/2013 DeAlva ..... 600/38

* cited by examiner

*Primary Examiner* — John P Lacyk
(74) *Attorney, Agent, or Firm* — Donn K. Harms

(57) ABSTRACT

A sexual aid device formed of a substantially U-shaped, member having a proximal end adapted for engagement within the vagina of a user distal end positioned to oppose the proximal end in a biased engagement with intra vaginal and external sexually sensitive surfaces of the user's body. A skeletal member running axially within said U-shaped member may be employed to vary the force of the biased engagement and reshape the U-shaped member. A projecting elongated member adjacent to the distal end of the U-shaped member is engageable by the user or body contact with a second user to impart force to the U-shaped member for sexual stimulation.

21 Claims, 7 Drawing Sheets

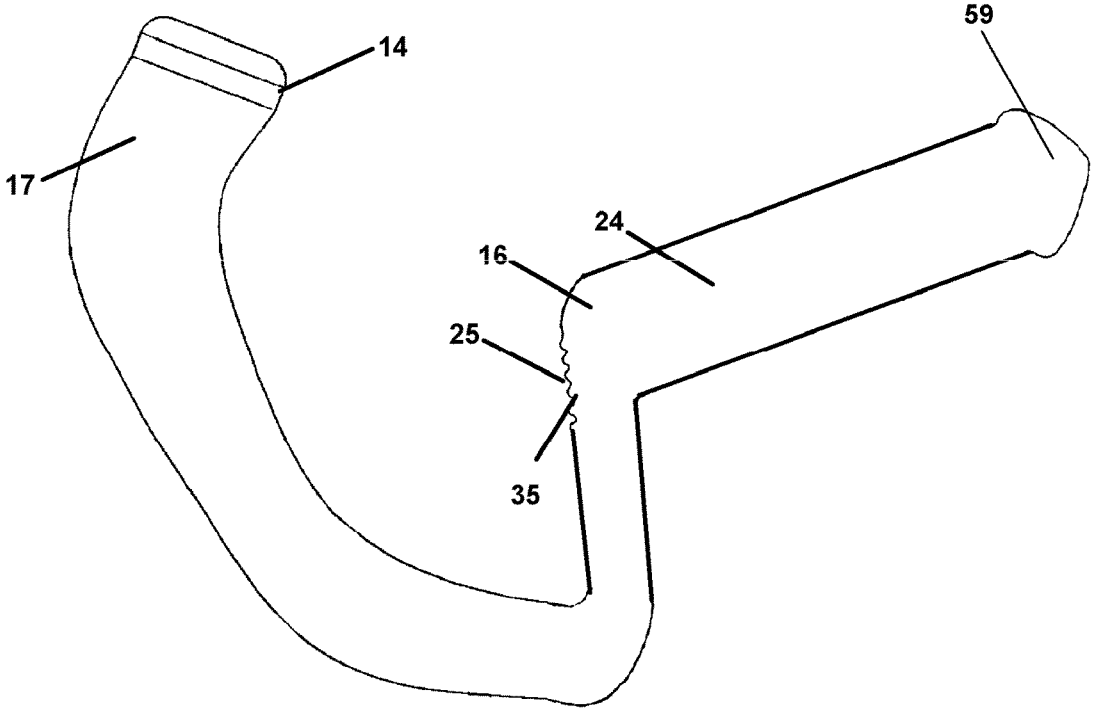
Fig. 10
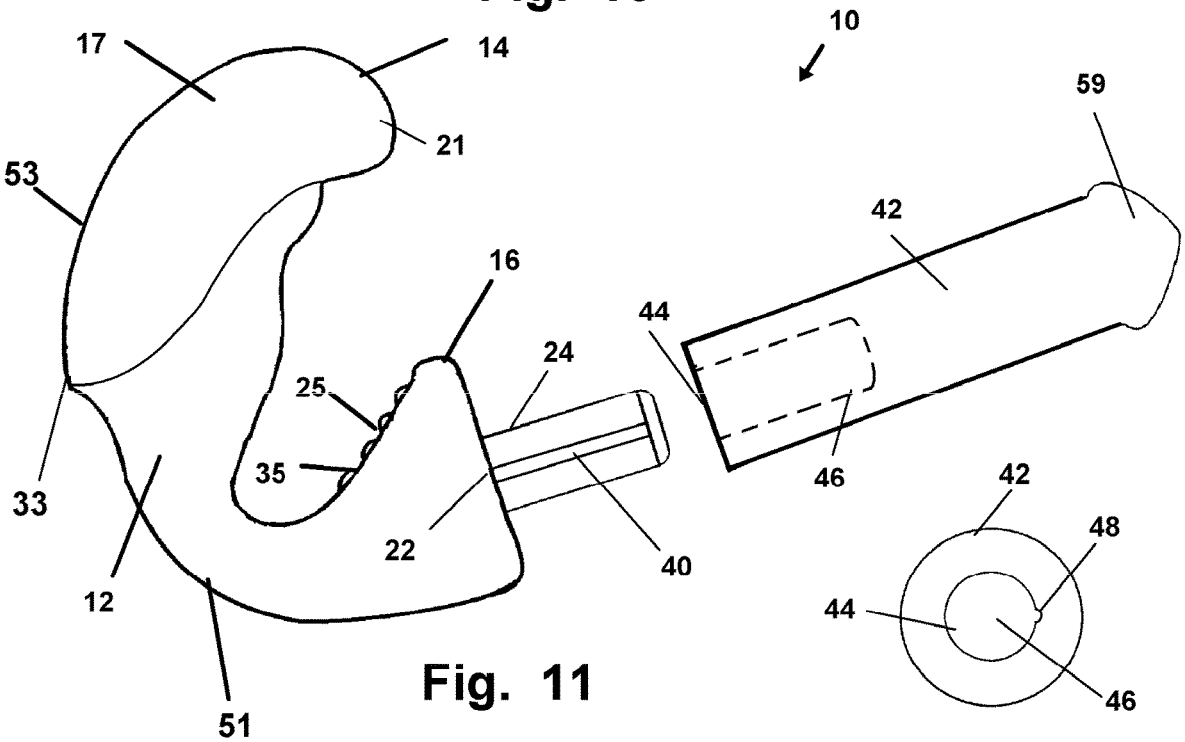
Fig. 11
Fig. 12

SEXUAL AID SYSTEM

This application is a Continuation-in-Part of U.S. Non-Provisional patent application Ser. No. 12/564,013 filed on Sep. 21, 2009, which claims priority to Provisional Patent Application No. 61/098,572 filed on Sep. 19, 2008, both of which are incorporated herein in their respective entirety by reference.

BACKGROUND OF THE INVENTION

1. Field of the Invention

The present invention relates to articles which are adapted to enhance sexual function and user pleasure. More specifically, the device relates to a sexual stimulation device which is retainable upon the female wearer without the aid of straps and belts and which may be adapted for concurrent use between two sexual partners or simply employed by a single user. The device is dimensioned in a manner to sexually stimulate intra vaginal and external erotic arousal areas of users. The device is further configured with means for removable engagement of at least one additional sexual stimulation component for employment on the users partner. The device may employ releasable locking means for maintaining the stimulation component in its engagement with the device during use thereof.

2. Prior Art

Sexual aids for increasing and inducing sexual pleasure have been known and employed in different cultures for hundreds of years. Such devices have been provided primarily with self-stimulation of the user in mind and therefor adapted for use by only one person.

Modernly, sexual aids have been developed which may be employed by one user or two parties during sexual intercourse between them. In the case of two females, conventionally such devices are generally a phallic shaped member which extends from a base engaged on one female and is employed to penetrate her partner. Such devices however employ straps and belts and other inconvenient components to remain mounted on the one female while being employed upon the other. They are as such, uncomfortable and inconvenient.

Further, these belt-engaged devices are generally not designed nor adapted to provide sexual stimulation to either individually or to both parties during their physical engagement. Thus, the sexual satisfaction of the party wearing the device, or in many cases on the receiving end of the device, can be severely lacking. Most conventional two-person devices employ a member to penetrate and provide sexual pleasure to one of the user's while in some fashion concurrently stimulating the wearer.

Variations of this type of device do include a dual ended phallic shaped member intended to be engaged within both females concurrently. However, since the device is mounted to neither partner, use to physically stimulate both parties concurrently requires some rather gymnastic maneuvers by both, and excellent timing in order not to cause a premature dismount from the device by either user.

Neither type of these sexual aids is adapted to be self-retained in either partner during a sexual encounter. Without the aid of straps and belts and mounts, or well-coordinated timing during employment of unmounted devices by both parties, disengagement and frustration will generally prevail.

In addition, it is conventional that the phallic shaped members employed on the dual ended and similar devices are permanently engaged in a single unit. Thus, partners wishing to employ varying types and geometries of sexual aid devices for providing varying degrees of sexual stimulation are required to interchange the stimulation device as a whole. The task of changing device may at be unfavorable for one partner or the other and is therefor an additional downfall with conventional device known in the art.

As such, there is an unmet need for a sexual aid device that is adapted for self-retention on at least one user during a mutual or individual sexual encounter. When employed with another partner, such a device should provide mutual simultaneous pleasurable feelings induced by the movement of both parties engaged with the device. Such a device should be adapted at a first end to provide intra vaginal and external sexual stimulation to the wearer singularly or when used with a partner. Such a device should be configured with a means for removable engagement of at least one additional simulation component, to provide concurrent intra vaginal and external stimulation to the other party during a sexual encounter with the wearer.

The forgoing examples of related art and limitation related therewith are intended to be illustrative and not exclusive, and they do not imply any limitations on the invention described and claimed herein. Various limitations of the related art will become apparent to those skilled in the art upon a reading and understanding of the specification below and the accompanying drawings.

SUMMARY OF THE INVENTION

The sexual stimulation device herein disclosed and described provides a unique solution to the noted shortcomings of the prior art. The device is self-retained without the aid of straps or belts or other means to maintain the device engaged physically with the user or wearer.

When employed with a female wearer, the device in one preferred mode, is adapted for the wearer to self-retain the curved elongated member in a mounted fashion upon the user's body in a position adapted to provided sexual stimulation during use. This engagement is maintained without the aid of belts or straps, instead employing a means for biasing the distal ends of the curved member toward each other and maintain a pressured clamping or engagement upon the intra vaginal and external body portions of the user. The device employing a generally U-shaped member, when employed by a female user, has a proximal end for intra vaginal engagement within the wearing user.

In at least one preferred mode, the U-shaped member includes a substantial girth increase transition from a lower end of the U-shaped member to the proximal end defining a proximal body portion being substantially wider than other parts of the U-shaped member. This girth transition includes an annular lip which communicating with the wider body portion which provides a means for self-retaining the device in an intra-vaginal engagement with the user. It is preferred that the lip is disposed in a location on the U-shaped member such that in the as worn mode, the lip is positioned to be naturally and ergonomically gripped by the intra-vaginal muscles providing the self-retaining means.

At a distal end opposite the proximal end, the device in one preferred mode provides an engagement point connector positioned adjacent to the distal end. This connector at an engagement point is adapted for engagement of a phallic shaped elongated member, which engaged adjacent to the distal end of the device will extend perpendicular therefrom for a distance. This connector may also be configured with a means for removable engagement of at least one removably engageable stimulation component also being substantially a phallic shaped elongated member, which when engaged adjacent to the distal end of the device will extend perpendicular therefrom for a distance.

In at least one preferred mode, the connector is in the form of an elongated member extending from the distal end of the U-shaped member. The elongated member may additionally include means for registering the engagement with the removably engageable stimulation component, in order to properly register the orientation of the removably engageable stimulation component with the device, as there may be a preferred as-used orientation of the simulation component. Additional preferred features, to be described in more detail below, include means for releasably locking the stimulation component in the engagement with the elongated member, means for venting or otherwise evacuating air from the receiving cavity of the stimulation component during the inserted engagement of the elongated member, as well as air cushion means disposed between elongated member and operatively engaged stimulation component.

The removably engageable stimulation component so engaged serves two purposes in that it allows a user, in a solo employment of the device, to grip it and use their hand force to move the component and the engaged curved member in different directions. This movement provides a means for increasing intra vaginal and external stimulation of the wearer's erogenous zones.

When the device is employed between two parties, the removably engageable stimulation component extending from the user-engaged curved member, may be employed to stimulate external erogenous areas of the partner. It may also be used to penetrate the wearer's sexual partner and provide intra vaginal sexual stimulation. This stimulation is enhanced by movement of the wearer and partner movements during joint use.

During joint use, physical contact of the member or operatively engaged stimulation component extending from the distal end of the device with a partner, will also produce force upon the curved member which serves to act upon the vaginally engaged proximal end to produce vibration, friction, and pressure upon the self-retained females own Grafenberg Spot or G-spot intra vaginally. This movement and force induced to the member by the concurrent engagement with the user and the sexual partner also acts to provide manual stimulation to the clitoris of the wearer having the device vaginally engaged at the proximal end. This stimulation to the wearer is constant during enjoyment with their partner and natural movements therebetween, and provides additional stimulation during normal sexual movements without the need for mechanical devices such as vibrators. This is because forces from the elongated member, or the stimulation component in modes employing the same, inducted by the partner are communicated to and act upon the U-shaped member.

The distal end of the U-shaped member is preferably dimensioned to position it partially against the lower abdomen of the female wearing the device. In the simplest mode of the device, wherein the U-shaped member is formed of resilient material such as silicone or polyethylene, a natural bias occurs of the distal end toward the proximal end once the two ends are pulled apart slightly from their neutral position. This bias serves to induce a clamping force of the device with pressure being communicated intra vaginally and externally to the wearer in two particularly sexually stimulating positions of their body.

In another preferred mode of the device the U-shaped member has an internal skeletal structure extending coaxially through most of the length of the body of the U-shaped member. The skeletal structure is covered by a surrounding resilient and flexible synthetic material such as silicone to thereby form the U-shaped member exterior portion.

In this mode of the device the internal skeletal structure is formed of material sufficiently resilient to provide an increase in the biasing of the proximal and distal ends toward each other. This biasing is a most important aspect of the device for self-retention without straps, and in order for it to provide direct contact of the proximal end with, and stimulation to the G-spot and the inside surface at the distal end with the clitoris. Clitoral stimulation is well known to be sexually stimulating and the G-spot is a nerve reflex area inside the vagina, along the anterior surface know to provide powerful sexual sensations to a female when properly stimulated. The biasing of the two ends of the U-shaped member produced a clamping effect and increased contact force with both sexually stimulating body parts of the female user.

The coaxial skeletal component may be a flexible material such as silicone or polyethylene of a harder durometer, and therefor stiffer than the external portion surrounding the coaxial skeletal component. Or, it may be formed of stiffer material such as fiberglass, spring steel or stainless steel positioned along the center axis of the U-shaped member for a substantial portion of its length. Formed in this fashion, U-shaped member upon a movement of the distal and proximal ends away from each other, will resist such movement with greater inward force than if the entire U-shaped member were formed of one type of silicone or resilient material as in the first mode of the device. Thus, the user gains an increase in the force of the surface contact of the external surface of the U-shaped members with intra vaginal and external sexual stimulation areas of their body.

Additionally preferred in an enhanced mode of the device is a means for user-configuring of the shape of the U-shaped member to increase sexual stimulation. In this mode, a plurality of malleable or bendable points are provided along the coaxial positioned skeletal structure. This allows the user a means for bending or articulating the skeletal component and thereby the surrounding skin of the device and thereby allow for exact positioning of the proximal end upon the G-spot. The user-configurable skeletal component also provides a means for adjusting the width of separation of the distal and proximal ends and the biasing force of both ends of U-shaped member towards each other. In this fashion, the user is afforded a means for achieving a better biased contact of the proximal end with the G-spot and the distal end against the lower abdominal wall and clitoral area of the wearing female. The combination of the biasing of both ends toward each other, and the adjusting of the width, shape, and positioning of the U-shaped member, thereby increases the users sexual stimulation in a customizable fashion and allows the device to be easily retained in the wearer without belts or other mounting devices from the clamping action which is also enhanced.

In other preferred modes the skeletal component may be formed of a continuous length articulateable material, such as resilient flat or rounded spring steal or other suitable material. Thus the device can be manufactured with less cost due to the singular skeletal member, albeit being suitably bendable and malleable, while the user is still provided with means for user-configuring of the shape of the U-shaped member and means for adjusting the width of separation.

The head portion of the device, located at the proximal end, is preferably shaped to stabilize the device by intra vaginal surface contact within the anatomic ledge formed above the pubic symphysis of the female wearing the device. The undersurface of this intra vaginal positioned head the U-shaped member is in continuous biased contact with the G-spot thereby providing direct physical stimulation thereto in a motion-energy transfer from the movement of either the wearer's hand on the device or movement of a sexual partner engaged upon the elongated member attached to the U-shaped member.

The distal end of the U-shaped member provides the user wearing the device constant physical contact and stimulation of the clitoral area with the exterior surface of the U-shaped member through the force and movement communicated from the sexual partner engaged upon the elongated member, or the wearer's hand upon the elongated member. An optional ribbed portion of the external surface, adjacent to the distal end of the U-shaped member, provides a means for increasing physical stimulating of the clitoral area. Thus, the device may be employed for increased sexual stimulation by the wearer alone imparting force to the elongated member, or by a partner through the movement of each other during intercourse and the resulting transfer of force and motion to the device.

A bifurcating ridge on an inner portion of the external surface of the U-shaped member, adjacent to the proximal end, serves to provide additional physical contact with the G-spot area and is especially preferred. The ridge projects away from the center axis of the U-shaped member a distance to allow it to bury into the flesh of the user in the G-spot area slightly more than the adjacent exterior surface.

Also preferred in a mode of the device, at a point adjacent to the distal end of the U-shaped member formed by a bend of the U-shaped member, is a hooked portion. The hooked portion is a portion of the member positioned intra vaginally, which bends inward toward the distal end at an increased angle. In use, the hooked portion provides an increased contact force at the proximal end of the U-shaped member within the anatomic ledge when positioned above the pubic symphysis. This hooked contact provides means for increasing the surface contact force with the G-spot while simultaneously providing a more stable clamping engagement of the device caused by the biasing of both ends toward each other.

As noted, in a preferred mode of the device an engagement point is provided adjacent to the elongated member at the distal end providing the means for removable engagement of an additional stimulation component also being substantially a phallic shaped elongated member. The removably engageable stimulation component can be provided in a kit form featuring a plurality of such elongated phallic shaped members of different lengths, configurations, and circumferences and shaped to allow the partner of the wearer to choose one which provides optimum sexual stimulation during intercourse.

Additionally, provided in one mode of the device herein, is the inclusion of means for vibration at the proximal end of the U-shaped member to provide vibratory stimulation to the G-spot. Also preferred is means for clitoral stimulation which currently is provided by one or a combination of raised edges positioned at an engagement point along the U-shaped member, and/or, a second means for vibration at the same engagement point. This means vibration at the distal end may be provided by engagement of a vibrator as the elongated member attachable adjacent to the distal end. This is especially preferred in that using a vibrator for the projecting elongated member will impart a vibrating action to the U-shaped member upon the adjacent clitoral region of the wearer while concurrently imparting a vibrating force to the partner of the wearer during contact on or with the elongated member.

With respect to the above description, it is to be understood that the invention is not limited in its application to the details of construction and to the arrangement of the components in this specification or illustrated in the drawings. The device and method herein described, providing a retainable sexual aid for females, is capable of other embodiments and of being practiced and carried out in various ways which will be obvious to those skilled in the art upon reading this disclosure. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed self-retained female sexual aid device. It is important, therefore, that the claims and disclosure herein be regarded as including such equivalent construction and methodology insofar as they do not depart from the spirit of the present invention.

It is an object of this invention to provide a sexual aid which may be self-retained on a user without the need for straps or mounting aids.

An additional object of this invention is the provision of G-spot and clitoral stimulation to a wearing female user through a clamping pressure and motion of the phallic shaped member engaged at the distal end of the device.

A further object of this invention is the provision of a sexual aid which allows a user to be stimulated by a sexual partner engaged with and acting upon the U-shaped member during a sexual encounter with that partner.

Yet another object of this invention, is the provision of a sexual aid which provides ongoing concurrent G-spot and clitoral stimulation with both pressure and vibration.

It is another object of the invention to provide a sexual aid device having an articulateable internal skeletal member formed of a continuous material which is bendable and malleable.

It is yet another object of the invention to provide a means for removable engagement of a stimulation component to the distal end of the device for employment with sexual stimulation of a partner.

It is yet another object of the invention to provide a means for releasable locking of a stimulation component to the distal end of the device.

It is still another object of the invention to provide a continuous internal skeletal member formed of spring steal or other suitable material.

These together with other objects and advantages which become subsequently apparent reside in the details of the construction and operation as heretofore described with reference being had to the accompanying drawings forming a part thereof, wherein like numerals refer to like parts throughout.

BRIEF DESCRIPTION OF DRAWING FIGURES

The accompanying drawings, which are incorporated herein and form a part of the specification, illustrate some, but not the only or exclusive, examples of embodiments and/or features. It is intended that the embodiments and figures disclosed herein are to be considered illustrative rather than limiting. In the drawings:

FIG. 10 shows the simplest mode of the disclosed device wherein the elongated member extends from the distal end of the U-shaped member in a unitary structure.

FIG. 11 shows a view of yet another mode of the device providing a means for removable engagement of an additional stimulation component to the elongated member engaged to the distal end of the U-shaped member, for communicating sexual stimulation to the users partner. The removably engageable stimulation component includes a receiving cavity for cooperatively receiving the elongated member extending from the distal end of the U-shaped member in a registered engagement.

Figure 11A:
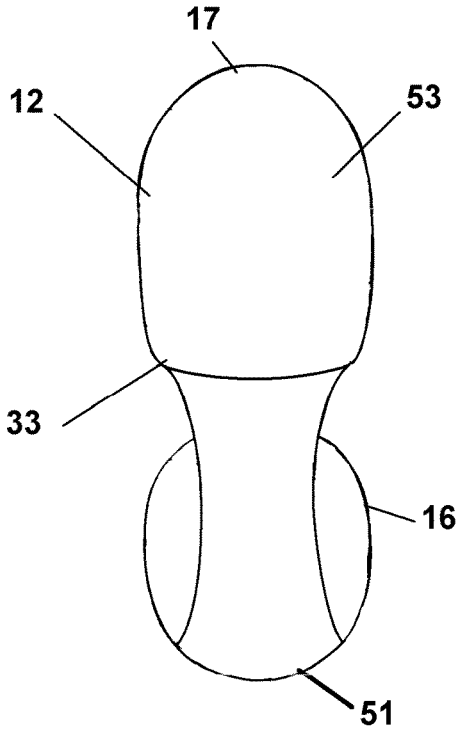

FIG. 11*a* shows a rear view of the mode of the device of FIG. 11 depicting the girth transition from the lower portion of the U-shaped member to a substantially wider body portion adjacent the proximal end.

FIG. 12 shows a rear view of the removably engageable stimulation component showing the receiving cavity providing means for registered engagement with the elongated member.

Figure 13:
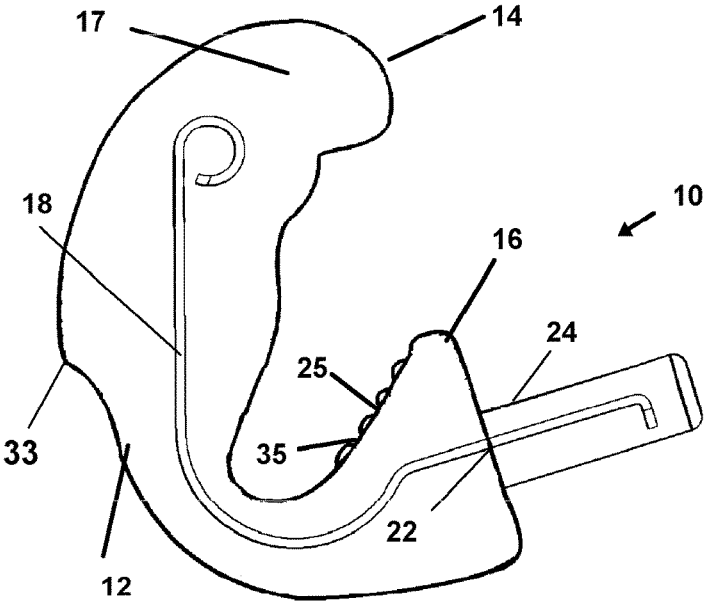

FIG. 13 shows a side view of the mode of the device of FIG. 11 showing the internal skeletal member formed of a continuous material.

Figure 14:
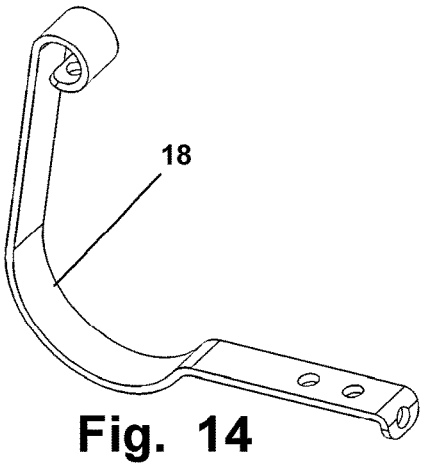

FIG. 14 shows a perspective view of a preferred mode of the internal skeletal member formed of a continuous material, such as flat spring steal.

Figure 15:
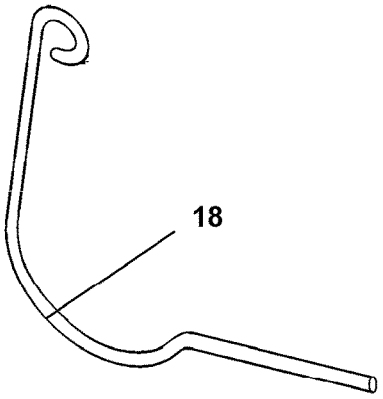

FIG. 15 shows a perspective view of another preferred mode of the internal skeletal member formed of a continuous material, such as round spring steal.

Figure 16:
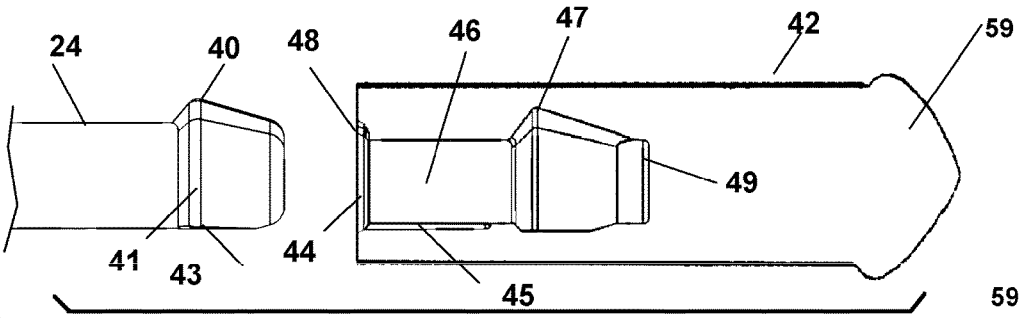

FIG. 16 shows a side cross sectional view depicting another preferred mode of the elongated member and receiving cavity of the removably engageable stimulation component providing releasable locking means and air venting means.

Figure 16A:
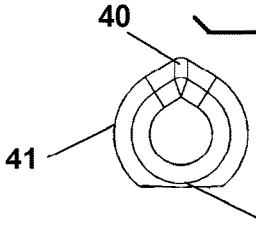

FIG. 16*a* shows a front view of the mode of the elongated member of FIG. 16.

Figure 16B:
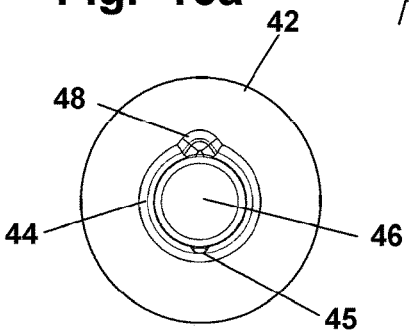

FIG. 16*b* shows a front view of the mode of the receiving cavity of the removably engageable stimulation component of FIG. 16.

Figure 17:
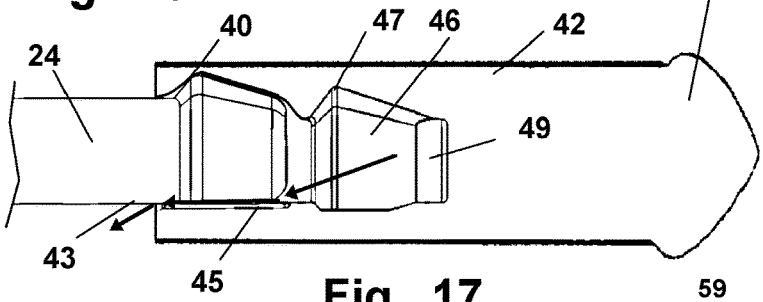

FIG. 17 shows the communication of the elongated member into the receiving cavity of the removably engageable stimulation component of FIG. 16.

Figure 17A:
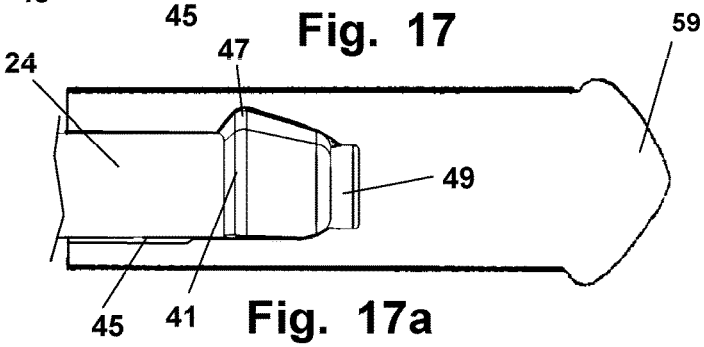

FIG. 17*a* shows the elongated member fully inserted within the receiving cavity of the removably engageable stimulation component of FIG. 16, showing an air cushion portion at the distal end of the cavity.

Figure 18:
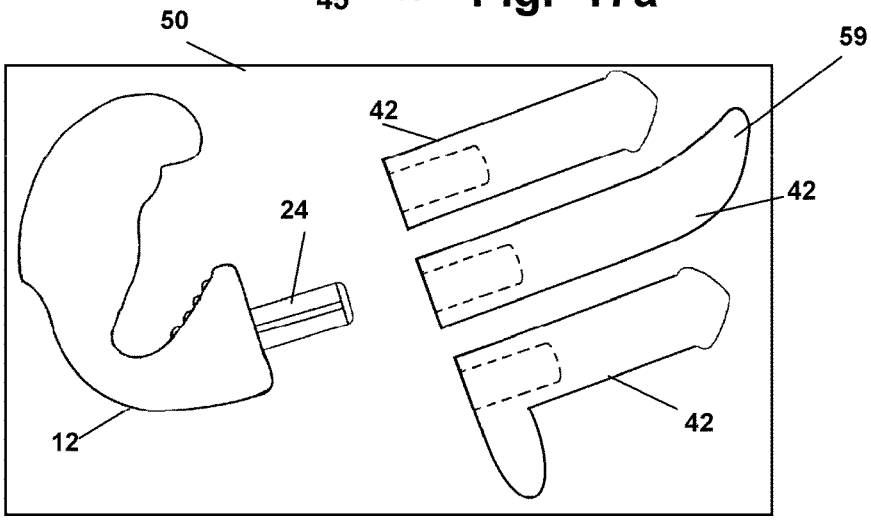

FIG. 18 shows a kit providable to the user comprising the U-shaped member and a plurality of different shaped removably engageable stimulation components of different lengths, and different circumferences or shapes, to allow the partner of the wearer to choose one which provides optimum sexual stimulation during intercourse.

DETAILED DESCRIPTION OF PREFERRED EMBODIMENTS

Referring now to the drawings of FIGS. 1-18 showing the sexual aid device 10 in various preferred modes, wherein similar parts are identified by like reference numerals which may be found in one or more of the drawings.

Figure 9:
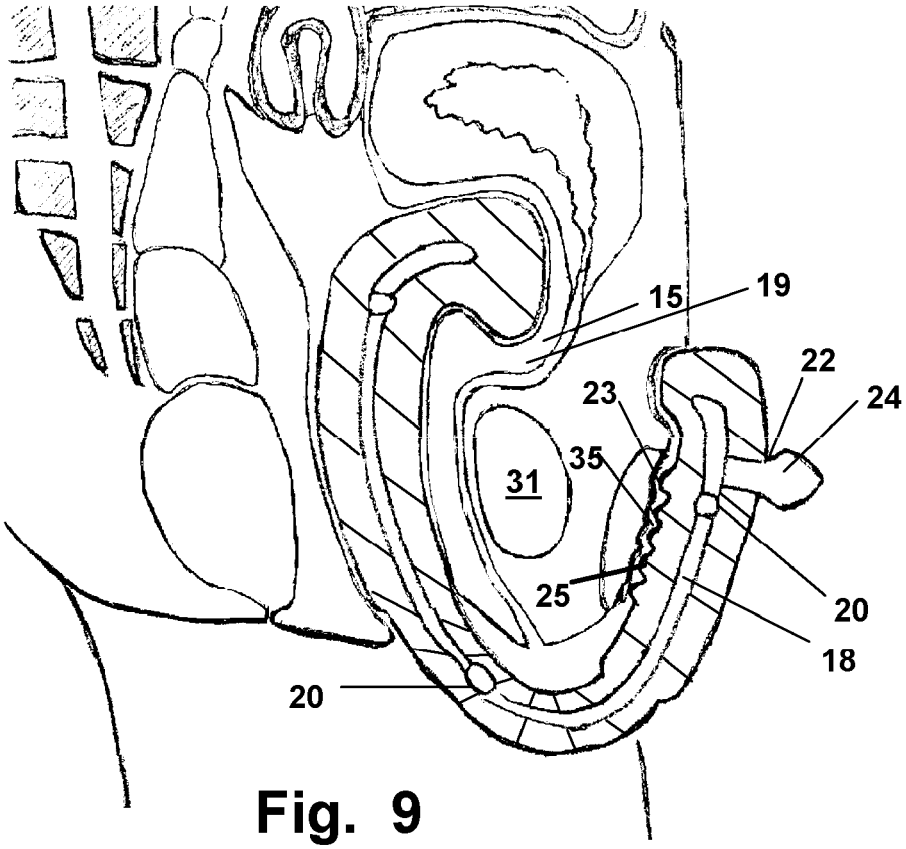
FIG. 9 depicts the device engaged with a female wearer having the proximal end in contact with the G-spot area and the distal end in contact with the clitoral area.
Figure 7:
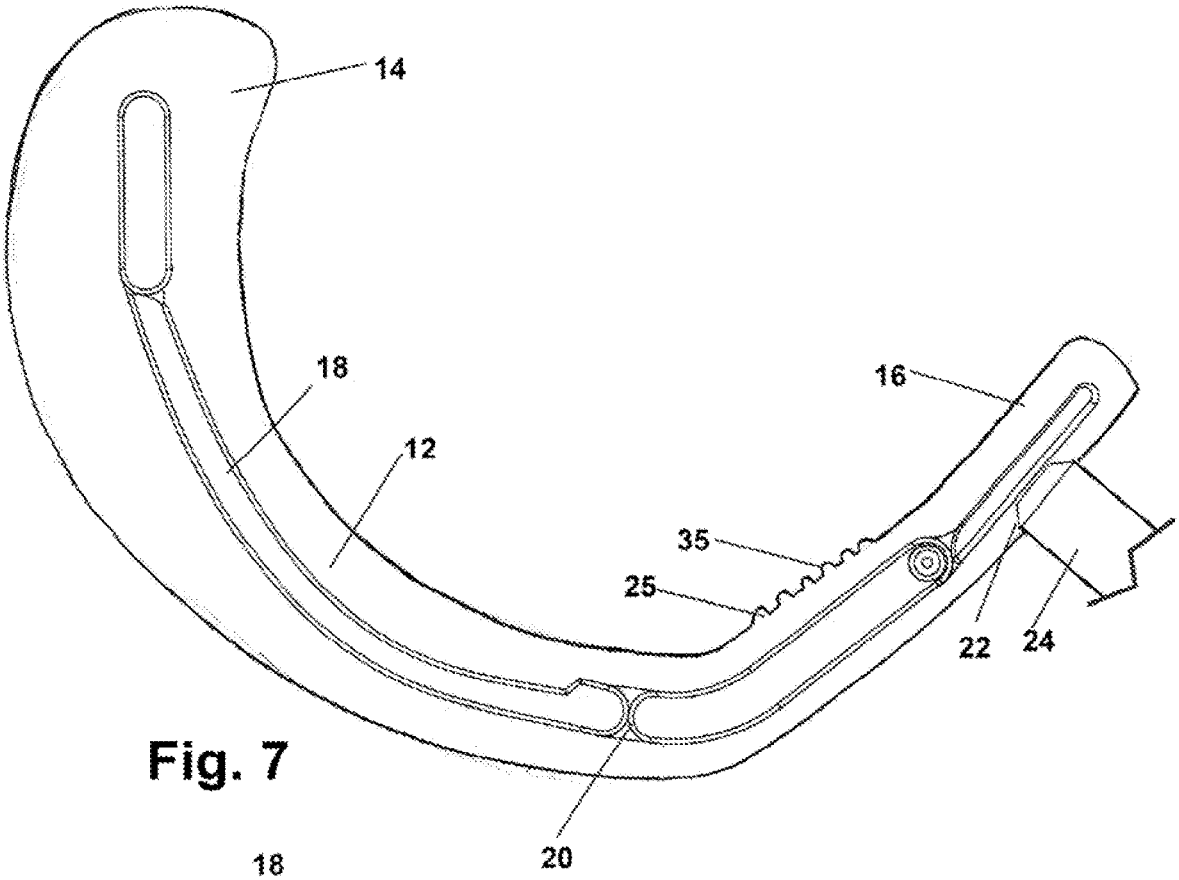
FIG. 7 shows the device of FIG. 1 having the coaxial skeletal member of FIG. 5 therein in an expanded position, and a removably engageable projecting member at the distal end.
Figure 8:
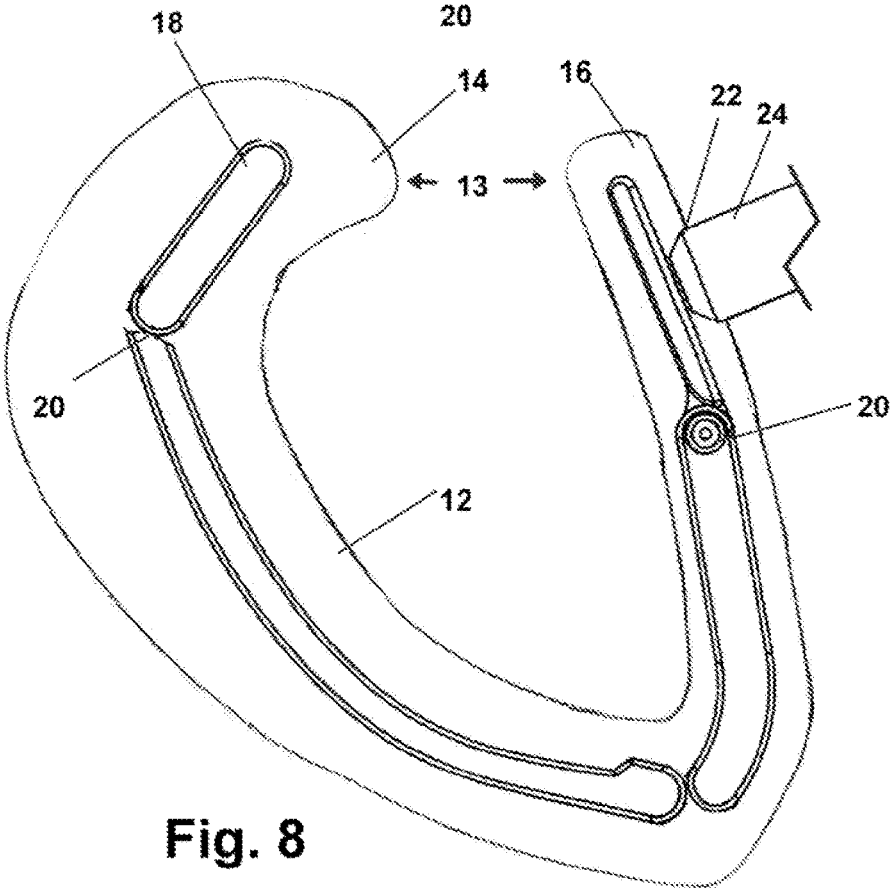
FIG. 8 depicts the device as in FIG. 7 having been moved to a compressed position by bending of bendable points of the skeletal member.

As shown in figures the device 10, is configured to provide a self-retained biased engagement of the device 10 with a female wearer, as shown in FIG. 9, without the aid of belts or straps but instead using a clamping action provided by a force of the ends of the device toward each other.

So employed, the device 10 has a generally U-shaped member 12 having a first or proximal end 14 which is adapted for a biased contact in an intra vaginal engagement with the wearer through a hooked portion 17 formed by a bend adjacent to the proximal end 14 of the U-shaped member 12. A projection 21 at the proximal end 14 provides increased force and friction with the G-spot area 19 of the female user as shown in FIG. 9, is preferred to increase sexual stimulation and provide a better mount of the proximal end 14 intra vaginally. The term "U-shaped" herein employed, is a general description of the shape of the member 12 and not intended in any fashion to limit the shape of the claimed device 10 which as those skilled in the art will realize could adjust to other shapes and serve the purpose intended.

Adjacent to the distal end 16 of the U-shaped member 12, opposite the proximal end 14, is located an external surface portion 35 adapted in a shape to provide enhanced frictional compressed engagement against the lower abdomen and clitoral area 23 of the female wearing the device 10. This frictional pressured engagement is provided in all modes of the U-shaped member 12. However it is particularly enhanced when a skeletal structure 18 is engaged axially within the U-shaped member 12.

Figure 1:
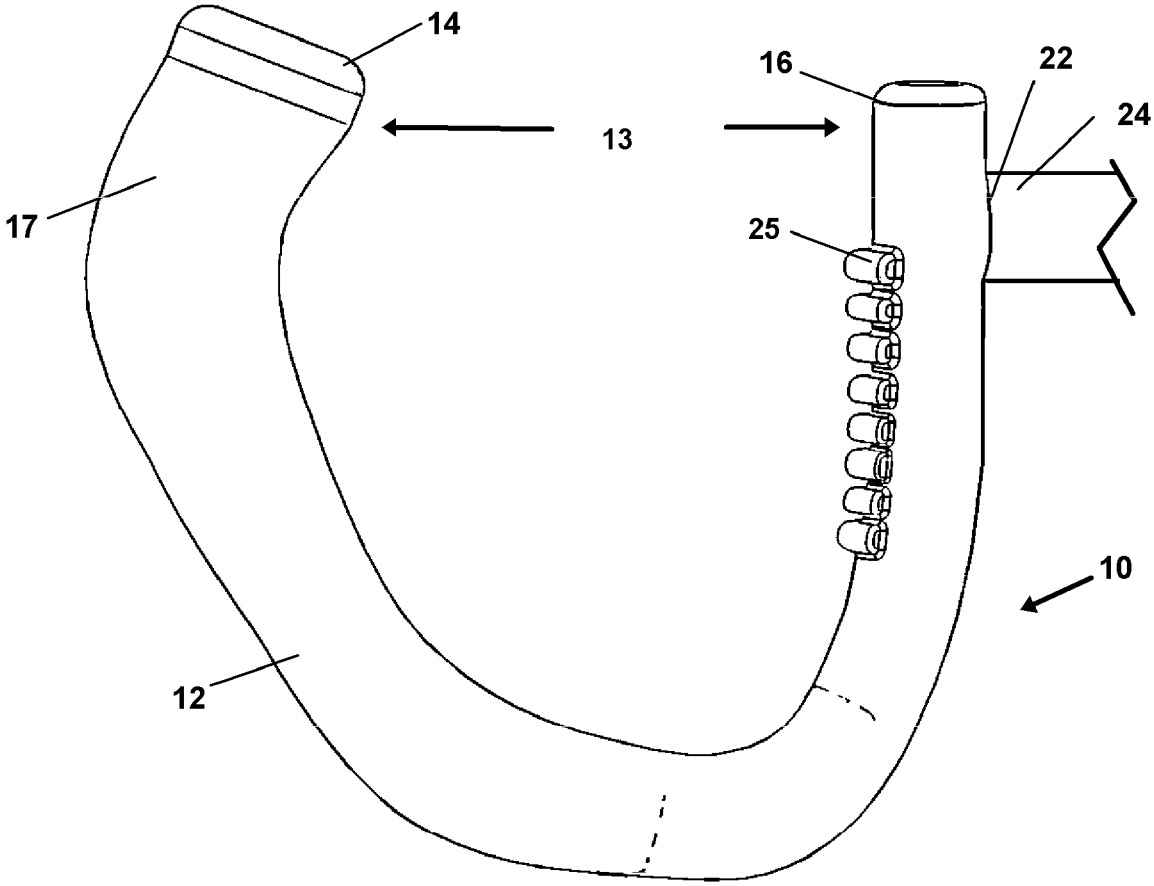
FIG. 1 shows a side view of one mode of the sexual aid device depicting the U-shaped member having an engageable projecting member adjacent to a distal end.
Figure 2:
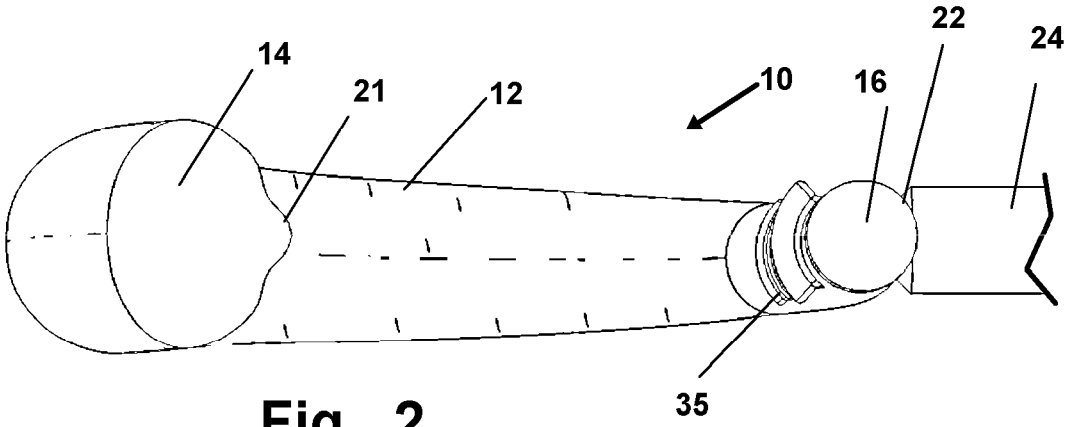
FIG. 2 is an overhead view of the device of FIG. 1 showing a larger body diameter of the U-shaped member at a proximal end and a projecting ridge from the exterior surface.
Figure 3:
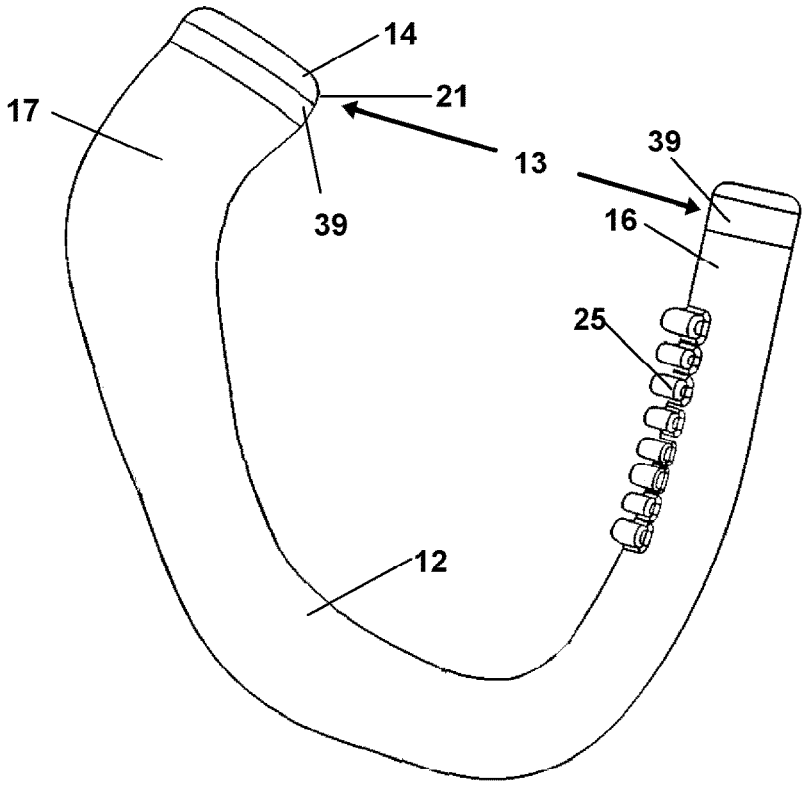
FIG. 3 depicts a mode of the device formed as a unitary structure without a projecting member at the distal end.
Figure 4:
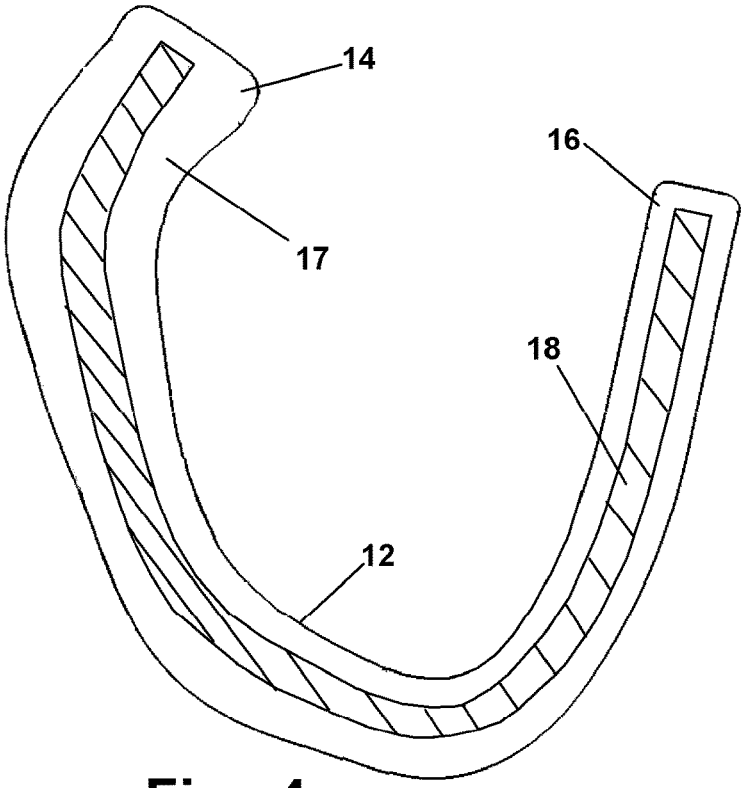
FIG. 4 shows a slice through the U-shaped member and a skeletal component running axially a distance through the U-shaped member.
Figure 5:
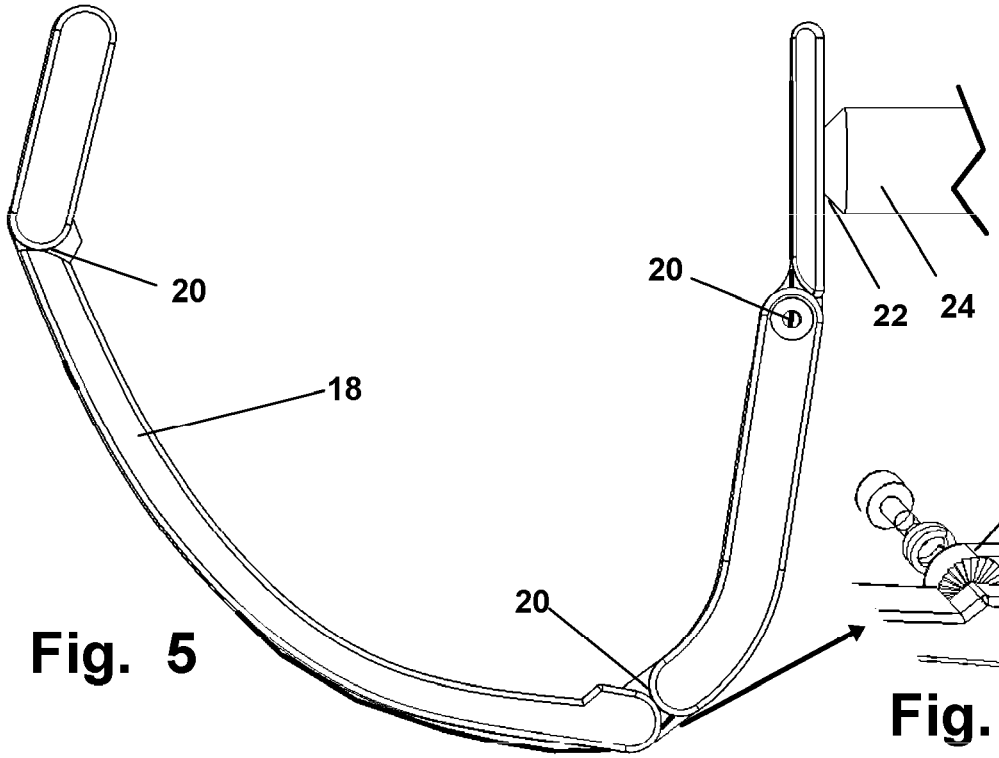
FIG. 5 depicts a user positionable skeletal member for coaxial engagement within the U-shaped member having bendable joints and an engagement for a projecting member.
Figure 6:
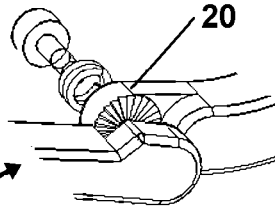
FIG. 6 shows the ratchet or clutch formed at the bendable points along the structure of FIG. 5.

The internal skeletal structure 18 may be formed of stiffer or higher durometer resilient plastic or silicon material, or by spring steel, fiberglass, or a material which is sufficiently resilient to provide an increased biasing proximal end 14 toward the distal end 16 once pulled apart from their static or original position as in FIGS. 3-4. The increase in distance between the proximal end 14 and distal end 16 occurs during engagement of the device in a wearer as in FIG. 9 where the body tissues serve to pull the two ends away, and the biasing force of the material forming the U-shaped member 12, or as enhanced by an included vibrator.

As noted, this biasing force is a most important aspect of the device 10 to provide for the self-retention, and an adjustable mechanical communication for motion transfer between the U-shaped member 12 and an elongated member 24 projecting from, and engaged with a co-operatively engageable engagement point 22 adjacent to the distal end 16 of the U-shaped member 12.

The elongated member 24 so engaged provides a user in a solo employment of the device 10, a handle of sorts to grip and impart their hand force to move the elongated member 24 and the engaged U-shaped member 12 in various different directions. This movement provides a means for increasing intra vaginal and external stimulation of the wearer's erogenous zones.

When the device 10 is employed between two parties, the elongated member 24 extending from the user-engaged U-shaped member 12, may be employed to stimulate external erogenous areas of the partner and/or to penetrate the wearer's sexual partner and provide intra vaginal sexual stimulation. This stimulation is enhanced by movement of the wearer and partner and resulting force imparted to the U-shaped member 12 by the elongated member 24 during such moments in a joint use.

When the elongated member 24 is engaged with the sexual partner, or used by the wearer's hand, the forces imparted to the U-shaped member 12 thereby provide direct physical contact and stimulation of the exterior of the proximal end 14 with the G-spot area adjacent to proximal end 14, and to the clitoral area 23 in contact with the distal end 16.

The skeletal structure 18 if malleable, provides a means for adjusting the gap 13 or space between the distal end 16 and proximal end 14 in the neutral position, as formed and not engaged with the wearer. Since making the gap smaller increases the biasing force and making it larger decreases that force, the adjusting of the shape of the U-shaped member 12 using the skeletal structure 18 provides a means for increasing or decreasing the biasing force toward the two ends, and the pressured engagement upon the ledge 19 above the pubic symphysis adjacent to the G-spot 15, and on the abdomen and clitoral area 23. For a malleable or configurable skeletal structure 18 a simple soft metal rod might be employed such as aluminum which may be bent and thus bend the shape of the U-shaped member 12. In a mode of the device 10 with increased utility, one or preferably a plurality of malleable or adjustable points 20 are positioned along the coaxially positioned skeletal structure 18 as in FIGS. 5-6. This allows the user to adjust the position of the proximal end 14 to achieve maximum stability and the most pleasurable sensations against the G-spot 15. It also allows the user to adjust the distance between the proximal and distal ends to vary the bias toward each other and achieve a compressed engagement of the ends 14 and 16 against the abdomen and G-spot 15 to hold the device 10 self retained. It further allows the user a means for adjustable pressure over the clitoral area 21.

To provide for concurrent external stimulation or penetration of a second user concurrently with the wearer, the engagement point 22 is provided to engage an elongated member 24 projecting from the U-shaped member 12. A conventional threaded or frictional engagement of a first end of the elongated member 24 with the U-shaped member 12 and or any skeletal component 18 may be employed. The elongated member 24 can be provided in a kit form, featuring a plurality of different elongated members 24 of different lengths, and different circumferences or shapes, to allow the partner of the wearer to choose one which provides optimum sexual stimulation during intercourse.

Particularly preferred in all modes of the device 10 is a means for clitoral area 23 stimulation which currently is provided by one or a combination of ridges 25 positioned at a clitoral stimulation point adjacent to the distal end 16 along the U-shaped member 12.

Further, in a particularly preferred mode of the device 10, at the proximal end 14 along the hooked portion 21 is a projection 21 forming a projection 21 and curved undersurface of the device 10 at the proximal end 14. This is most important in that it serves to provide a stable mount for the device 10 with the curved undersurface of the hooked portion 17 and with the projection 21 resting upon the ledge over the pubic bone 31. This serves to sandwich the G-spot 15 between the device 10 and the pubic bone 31 and to maintain the device 10 in a stable position on the user without belts or other exterior supports as the projection 21 is supported by the underlying pubic bone 31 stops excessive rotation of the device 10 and helps maintain the distal end 16 in a correct position outside the body of the wearer. This engagement means has been found to be especially stable without the need for belts or straps to hold the device 10 during use with two people, and to also provide constant contact of the area adjacent to the proximal end 14 with the G-spot 15 for intense and constant stimulation to the user simulating transfer of motion energy from the phallic shaped elongated member engaged with the sexual partner.

In one preferred mode of the device 10 herein, optionally a means for vibration 39 at the proximal end 14 of the U-shaped member 12 may be provided to provide direct vibratory stimulation to the G-spot 15 in biased engagement with the proximal end 14. Such vibration would be in addition to the pressure and movement provided by the direct energy transfer from movement of the sexual partner upon the elongated member 24 projecting extension.

Additionally, and particularly preferred, the elongated member 24 engaged adjacent to the distal end 16 of the device 10 may be a vibrator. So configured, the elongated member 24 would communicate vibration to the U-shaped member 12 and stimulating spots on the wearer, and also provide intense physical stimulation to a partner with whom the vibrating elongated member 24 would be in contact.

While the most preferred modes of the device 10 show the elongated member 24 being engageable to the distal end 16 of the U-shaped member 12, the device 10 can be formed in a unitary structure in a once-piece mode as shown in FIGS. 10 and 11. This would be the simplest mode of the disclosed device 10 and would still provide the biased inward force of the two ends of the U-shaped member 12 to achieve the engagement with a user. However it may be formed of a single piece of silicone or with a skeletal component 18 running axially through the U-shaped member 12 and optionally through the axis of the elongated member 24. This mode while simple in construction still provides a huge leap in performance and function to users from conventional sexual aids offering no biased engagement with a user nor provision of an elongated member 24 to transfer motion forces to the wearer from the partner and vice versa.

In yet another particularly preferred mode shown in FIG. 11, the elongated member is shown formed unitarily with the U-shaped member 12. In this mode the elongated member 24 extending from the distal end 16 thereof serves a plurality of purposes. Firstly, as described in previous modes, the elongated member 24 provides a user in a solo employment of the device 10, a handle to grip and impart their hand force to move the elongated member 24 and the engaged U-shaped member 12 in various different directions. Further, when the device 10 is employed between two parties, the elongated member 24 extending from the user-engaged U-shaped member 12, may be employed to stimulate external erogenous areas of the partner and/or to penetrate the wearer's sexual partner and provide intra vaginal sexual stimulation.

In addition, and especially preferred with current modes of the disclosed device, the elongated member 24 serves as a means for removable engagement of a removably engageable stimulation component 42 at or adjacent to the distal end, the stimulation component preferably being an elongated member or a substantially phallic shaped member as shown. Thus, the engagement of the removably engageable stimulation component 42 at or adjacent to the distal end, provides enhanced means for sexual simulation of the wearers partner as it is generally formed larger than the elongated member 24. This engagement may be permanent or preferably removable to allow for interchanging various stimulation components 42 from a kit thereof.

Means for cooperative engagement of the simulation component 42 to the elongated member 24, can be provided by forming the elongated member 24 preferably having a longitudinal projection 40, extending a distance along and away from the exterior surface of the elongated member 24 as shown. An aperture 44 (FIG. 12) communicates with the receiving cavity 46 of the stimulation component 24 which is dimensioned for receiving the elongated member 24, in a frictional or otherwise secured removable engagement thereto. This engagement may include a complimentary longitudinal cavity 48 which upon an engagement of the component 42 to the elongated member 24, preferably aligns with the projection 40 to form a registered engagement. This registered engagement may be preferred if the axis of the stimulation component 42, or its tip 59, is to be employed at a certain angle away from the axis of the elongated member 24, or another preferred registered orientation or angle of the stimulation component 42 relative to the elongated member 24 during penetration internally through an orifice of the wearer's partner.

In addition, as can be seen in FIG. 11 and FIG. 11*a*, the U-shaped member 12 in the current mode includes a substantial girth increase, transitioning from a lower end 51 of the U-shaped member 12, to the proximal end 14 wherein a body portion 53 being wider relative the remaining U-shaped member 12. This girth transition includes an annular lip 33 communicating with the wider body portion 53, which when in the as worn mode, provides a means for self-retaining the device 10 in the intra-vaginal engagement with the user. It is preferred that the lip 33 is disposed in a location distanced from the proximal end 14 and lower end 51 such that in the as worn mode, the lip 33 will be naturally and ergonomically gripped by the intra-vaginal muscles providing the self-retaining means. If provided in kit form, various lengths and girths of the stimulation component 42 may be provided in the kit or available commercially from a kit provided to allow for the partner or user to choose the most appropriate stimulation component 42 for themself from the plurality available in the kit.

FIG. 13 shows another preferred mode depicting the skeletal component 18 current shown formed of a continuous length of articulateable material, extending from the axis of an elongated member 24 to a position proximate to the proximal end 14, such as resilient flat (FIG. 14) or rounded (FIG. 15) spring steal or other suitable material. By providing a singular piece of material in a continuous length for the skeletal component 18, it is intended that the device 10 can be manufactured with less cost due to the singular skeletal member 18 and the skeletal member 18 will communicate any movement imparted to the elongated member 24 from a hand contact by the user or their partner, or a movement during an internal engagement with the partner, in a concurrent reciprocal responsive movement of the U shaped member 12 and or the end 14.

However, it is additionally intended that the material be chosen to maintain a suitable amount of subsequent bendability and malleability in subsequent use sessions, to the U shaped member 12, insofar as to continue to provide the user with means for user-configuring of the shape of the U-shaped member and means for adjusting the width of separation of the proximal 14 and distal 16 ends.

FIG. 16-17*a* show views of additional particularly preferred modes of the elongated member 24 and receiving cavity 46 of the stimulation component 42. In the figures, the distal end of the elongated member includes a locking ridge 41, generally being wider than the elongated member's 24 shaft, and at least one flat surface 43. Means for releasably locking the elongated member 24 to the stimulation component 42 is provided by forming the receiving cavity 46 of the stimulation component 42 with a complimentary recess 47 shaped and formed to engage the locking ridge when fully inserted in to the cavity 46 as shown in FIG. 17*a*. Those skilled in the art will envision that the locking force provided by the ridge 41 and recess 47 will be determined by the flexibility of the material of the stimulation component. However it is preferred that the force provided is sufficient to resist disengagement during employment of the device 10, however can still be disengaged by the user when desired simply by applying opposing pulling forces on the device 10 and stimulation component 42.

It is noted that those skilled in the art may envision various other means for releasably locking the stimulation component 42 with the elongated member 24, however without departing from the scope and intent of the invention, are anticipated. As such the current depiction is provided merely for demonstrative purposes of one preferred mode, and should not be considered limiting.

It is noted that ease of insertion of the elongated member 24 into the cavity 46 can be enhanced by venting back pressure air which may build up in the cavity as the elongated member 24 is advanced inward. As such, means for venting or otherwise evacuating air from the receiving cavity 46 of the stimulation component 42 during the insertion of the elongated member 24 is additionally provided. The cavity 46 includes an air vent channel 45 extending from the open aperture 44 a distance into the cavity 46. During insertion of the elongated member 24, the flat surface 43 aligns with the channel 45 however without obstructing the channel 45, such that back pressure air built up within the cavity 46 can be vented from the cavity 46 through the channel 45 as the elongated member 24 is communicated therein as shown in FIG. 17. As such, the user can easily engage and disengage the stimulation component 42 without the need for excessive force or with the use of lubricants.

Further, as clearly shown in FIG. 17*a*, the depth of the cavity 46 can be formed slightly or moderately longer than the length of the elongated member 24. Thus, in the fully inserted position as shown, an air cushion portion 49 is provided at the distal end of the cavity 46. The air cushion portion 49 has shown to provide a shock absorbing air cushion means between the elongated member 24 and stimulation component 42 to dampen an inadvertent hard thrust by the wearer to their partner.

FIG. 18 shows a kit 50 which is providable to the user comprising the U-shaped member 12 and a kit having a plurality of different shaped removably engageable stimulation components 42 of different lengths, and different circumferences or shapes, to allow the user or their partner to choose any one from the kit which provides optimum sexual stimulation during intercourse and engage it to the U-shaped member. Of course it is noted that the geometries and quantity of the stimulation components 42 provided in the kit 50 can be varied as deemed suitable by the designer, and should not be considered limited by the current depiction. It is additionally noted and anticipated that in other modes the kit 50 may be providable without the U-shaped member 50, wherein the user purchases the U-shaped member 50 separately, and can then purchase any one member of or a complete desirable kit 50 comprising a plurality of different stimulation components 42 of different lengths, exterior configurations, circumferences and shapes.

While all of the fundamental characteristics and features of the sexual aid system herein have been shown and described, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed is:

1. A sexual aid apparatus, comprising:

a substantially U-shaped, member having a proximal end and distal end; and said proximal end positioned to oppose said distal end at a distance therefrom, said distance defined by a gap;

said proximal end and said distal end of said U-shaped member resisting movement away from each other, to positions widening said gap thereby resulting in a biased engagement of said proximal end and distal end to a body of a first user;

a skeletal member running axially within said U-shaped member;

said skeletal member component providing means for adjusting a force of said biased engagement to said body of said first user;

a stimulation component at or adjacent to said distal end;

wherein said sexual aid is engageable to said body of said first user by said force of said biased engagement of said proximal end against an internal structure of the body of first said user, and said biased engagement of said distal end against an exterior surface of said body of said first user, when said U-shaped member is positioned in an as-used position with said internal structure and said exterior surface within said gap;

said stimulation component with said sexual aid in said as-used position engageable with a hand contact therewith, by either said first user or said second user;

said stimulation component with said sexual aid in said as-used position being engageable in an internal contact through an orifice of a body of said second user, and movement of said stimulation component imparted thereto from either said hand contact or said internal contact, thereby communicating a reciprical movement of said U-shaped member in said biased engagement.

2. The sexual aid apparatus of claim 1 additionally comprising:

said skeletal member formed of one or a combination of skeletal materials, from a group of skeletal materials including aluminum, stainless steel, fiberglass, and resilient plastic material having a durometer higher than that of said member.

3. The sexual aid apparatus of claim 1 additionally comprising:

said skeletal member formed of malleable material, said malleable material bendable for a reshaping of said U-shaped member.

4. The sexual aid apparatus of claim 1 additionally comprising:

a substantially hook shaped undersurface adjacent at said proximal end; and said undersurface providing means for supporting said proximal end upon an underlying ledge positioned over a pubic bone of said first user with said U-shaped member positioned in said as-used position.

5. The sexual aid apparatus of claim 2 additionally comprising:

a substantially hook shaped undersurface adjacent at said proximal end; and said undersurface providing means for supporting said proximal end upon an underlying ledge positioned over a pubic bone of said first user with said U-shaped member positioned in said as-used position.

6. The sexual aid apparatus of claim 3 additionally comprising:

a substantially hook shaped undersurface adjacent at said proximal end; and said undersurface providing means for supporting said proximal end upon an underlying ledge positioned over a pubic bone of said first user with said U-shaped member positioned in said as-used position.

7. The sexual aid apparatus of claim 1 wherein said means for removable engagement at or adjacent to said distal end, comprises:

an elongated member extending from said U-shaped member from a position at or adjacent to said distal end;

said stimulation component having an aperture communicating with a receiving cavity, said receiving cavity sized for receiving said elongated member in a removable frictional engagement thereto.

8. The sexual aid apparatus of claim 2 wherein said means for removable engagement at or adjacent to said distal end, comprises:

an elongated member extending from said U-shaped member from a position at or adjacent to said distal end;

said stimulation component having an aperture communicating with a receiving cavity, said receiving cavity sized for receiving said elongated member in a removable frictional engagement thereto.

9. The sexual aid apparatus of claim 3 wherein said means for removable engagement at or adjacent to said distal end, comprises:

an elongated member extending from said U-shaped member from a position at or adjacent to said distal end;

said stimulation component having an aperture communicating with a receiving cavity, said receiving cavity sized for receiving said elongated member in a removable frictional engagement thereto.

10. The sexual aid apparatus of claim 4 wherein said means for removable engagement at or adjacent to said distal end, comprises:

an elongated member extending from said U-shaped member from a position at or adjacent to said distal end;

said stimulation component having an aperture communicating with a receiving cavity, said receiving cavity sized for receiving said elongated member in a removable frictional engagement thereto.

11. The sexual aid apparatus of claim 5 wherein said means for removable engagement at or adjacent to said distal end, comprises:

an elongated member extending from said U-shaped member from a position at or adjacent to said distal end;

said stimulation component having an aperture communicating with a receiving cavity, said receiving cavity sized for receiving said elongated member in a removable frictional engagement thereto.

12. The sexual aid apparatus of claim 6 wherein said means for removable engagement at or adjacent to said distal end, comprises:

an elongated member extending from said U-shaped member from a position at or adjacent to said distal end;

said stimulation component having an aperture communicating with a receiving cavity, said receiving cavity sized for receiving said elongated member in a removable frictional engagement thereto.

13. The sexual aid apparatus of claim 7 additionally comprising:

said elongated member shaped to engage in a registered engagement of said receiving cavity of said stimulation component to said elongated member; and said registered engagement providing a positioning of said stimulation component or its tip, at a predetermined angle relative to an axis of said elongated member.

14. The sexual aid apparatus of claim 8 additionally comprising:

said elongated member shaped to engage in a registered engagement of said receiving cavity of said stimulation component to said elongated member; and said registered engagement providing a positioning of said stimulation component or its tip, at a predetermined angle relative to an axis of said elongated member.

15. The sexual aid apparatus of claim 9 additionally comprising:

said elongated member shaped to engage in a registered engagement of said receiving cavity of said stimulation component to said elongated member; and said registered engagement providing a positioning of said stimulation component or its tip, at a predetermined angle relative to an axis of said elongated member.

16. The sexual aid apparatus of claim 10 additionally comprising:

said elongated member shaped to engage in a registered engagement of said receiving cavity of said stimulation component to said elongated member; and said registered engagement providing a positioning of said stimulation component or its tip, at a predetermined angle relative to an axis of said elongated member.

17. The sexual aid apparatus of claim 11 additionally comprising:

said elongated member shaped to engage in a registered engagement of said receiving cavity of said stimulation component to said elongated member; and said registered engagement providing a positioning of said stimulation component or its tip, at a predetermined angle relative to an axis of said elongated member.

18. The sexual aid apparatus of claim 15 additionally comprising:

said skeletal member formed of a continuous length of said skeletal material extending from a first point positioned along the axis of said elongated member to a second point proximate to said proximal end.

19. The sexual aid apparatus of claim 17 additionally comprising:

said skeletal member formed of a continuous length of said skeletal material extending from a first point positioned along the axis of said elongated member to a second point proximate to said proximal end.

20. A sexual aid kit having a sexual aid apparatus comprising:

a substantially U-shaped member having a proximal end and distal end, said proximal end positioned to oppose said distal end at a distance therefrom, said distance defining a gap;

said proximal end and said distal end of said U-shaped member resisting movement away from each other which increase said gap thereby forming a biased engagement of said proximal end and distal end to a body of a user;

a skeletal member formed of malleable material bendable to provide a means for reshaping said U-shaped member running axially within said U-shaped member;

said skeletal member component providing means for adjusting a force of said biased engagement to said body of said user;

a stimulation component removably engageable at or adjacent to said distal end; and said stimulation component being one of a kit of elongated phallic shaped member, said kit including:

a plurality of said stimulation components of different lengths, exterior configurations, circumferences and shapes; and whereby a partner or said user may choose and engage any one of said plurality of said stimulation components to said U-shaped member.

21. A sexual aid apparatus, comprising:

a substantially U-shaped, member having a proximal end and distal end; and said proximal end positioned to oppose said distal end at a distance therefrom, said distance defined by a gap;

said proximal end and said distal end of said U-shaped member resisting movement away from each other, to positions widening said gap thereby resulting in a biased engagement of said proximal end and distal end to a body of a first user;

said u-shaped component being malleable to allow bending to adjust said gap to thereby provide and adjustment to a force of said biased engagement to said body of said first user;

a stimulation component engaged at or adjacent to said distal end;

wherein said sexual aid is engageable to said body of said first user by said force of said biased engagement of said proximal end against an internal structure of the body of first said user, and said biased engagement of said distal end against an exterior surface of said body of said first user, when said U-shaped member is positioned in an as-used position with said internal structure and said exterior surface within said gap;

said stimulation component with said sexual aid in said as-used position engageable with a hand contact therewith, by either said first user or said second user;

said stimulation component with said sexual aid in said as-used position being engageable in an internal contact through an orifice of a body of said second user, and movement of said stimulation component imparted thereto from either said hand contact or said internal contact, thereby communicating a reciprocal movement of said U-shaped member in said biased engagement.

* * * * *